US009343014B2

(12) United States Patent
Huang et al.

(10) Patent No.: US 9,343,014 B2
(45) Date of Patent: May 17, 2016

(54) PIXEL DRIVING CIRCUIT

(71) Applicant: AU OPTRONICS CORP., Hsin-Chu (TW)

(72) Inventors: Guan-Ru Huang, Hsin-Chu (TW); Chia-Yuan Yeh, Hsin-Chu (TW); Chun-Yen Liu, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/564,642

(22) Filed: Dec. 9, 2014

(65) Prior Publication Data

US 2016/0098955 A1 Apr. 7, 2016

(30) Foreign Application Priority Data

Oct. 1, 2014 (TW) ..... 103134260 A

(51) Int. Cl.
*G09G 3/30* (2006.01)
*G09G 3/32* (2016.01)

(52) U.S. Cl.
CPC ..... *G09G 3/3233* (2013.01); *G09G 2320/0233* (2013.01)

(58) Field of Classification Search
CPC ..... G09G 3/30; G09G 5/00; G09G 3/20; G09G 3/10; G06F 3/038; H05B 37/00; H05B 39/00
See application file for complete search history.

(56) References Cited

U.S. PATENT DOCUMENTS 8,564,512 B2 10/2013 Chung
8,736,597 B2 * 5/2014 Kim ..... G09G 3/3258 345/214
8,743,027 B2 6/2014 Wu et al.
2008/0224965 A1 * 9/2008 Kim ..... G09G 3/3233 345/76
2011/0157126 A1 * 6/2011 Chung ..... G09G 3/3233 345/211
2011/0164071 A1 7/2011 Chung et al.
2013/0063040 A1 3/2013 Huang et al.

FOREIGN PATENT DOCUMENTS

JP 2011158821 8/2011

* cited by examiner

*Primary Examiner* — Pegeman Karimi
(74) *Attorney, Agent, or Firm* — WPAT, P.C.; Justin King

(57) ABSTRACT

A pixel driving circuit includes first to seventh switches, a capacitor and a light emitting unit. The first and sixth switches are connected and receive data voltage and second reference voltage according to second and third control signals, respectively. One capacitor end connects to the serial-connected first and sixth switches and the other capacitor end connects to a control end of the second switch. The serial-connected third and fourth switches are connected between the control and first end of the second switch. The third and fourth switches are ON by the second control signal. The fifth switch is ON by a first control signal. An end of the fifth switch connects to the serial-connected third and fourth switches and another end receives a first reference voltage. The seventh switch is connected between the second switch and the light emitting unit. The seventh switch is ON by the third control signal.

4 Claims, 4 Drawing Sheets

PIXEL DRIVING CIRCUIT

TECHNICAL FIELD

The present disclosure relates to a pixel driving circuit, and more particularly to a pixel driving circuit of OLED display.

BACKGROUND

At present, OLED display have been widely used in various types of display apparatuses, wherein it is understood that the luminance of an OLED corresponds to the driving current thereof and the driving current is controlled by a related driving transistor. However, because the driving transistors of pixels in a display apparatus may not have the same threshold voltage (Vth) due to the manufacturing process, the driving transistors may generate different driving currents and accordingly the OLEDs in different pixels may have different luminance. Hence, the display apparatus may have non-uniformity problem while displaying images. Thus, it is quite important to develop a pixel driving circuit capable of compensating the threshold voltage of driving transistor.

SUMMARY

Therefore, an aspect of the present disclosure is to provide a plurality of pixel driving circuits capable of compensating the threshold voltage of driving transistor thereby having improved luminance uniformity while displaying images.

The present disclosure provides a pixel driving circuit, which includes a first switch, a second switch, a third switch, a fourth switch, a fifth switch, a sixth switch, a seventh switch, a capacitor and a light emitting unit. The first switch has a first end, a second end and a control end. The first switch is configured to have its first end electrically coupled to a data voltage. The second switch has a first end, a second end and a control end. The second switch is configured to have its first end electrically coupled to a first operation voltage source. The third switch has a first end, a second end and a control end. The third switch is configured to have its first end electrically coupled to the control end of the second switch. The fourth switch has a first end, a second end and a control end. The fourth switch is configured to have its first end electrically coupled to the second end of the third switch and its second end electrically coupled to the second end of the second switch. The fifth switch has a first end, a second end and a control end. The fifth switch is configured to have its control end electrically coupled to a first control signal, its first end electrically coupled between the second end of the third switch and the first end of the fourth switch, and its second end electrically coupled to a first reference voltage. The fifth switch receives the first reference voltage according to the first control signal. The first, third and fourth switches are further configured to have their control ends electrically coupled to a second control signal, respectively, and are ON/OFF according to the second control signal. The capacitor is electrically coupled between the second end of the first switch and the control end of the second switch. The sixth switch has a first end, a second end and a control end. The sixth switch is configured to have its control end electrically coupled to a third control signal, its first end electrically coupled to a second reference voltage, and its second end electrically coupled between the second end of the first switch and the capacitor. The sixth switch receives the second reference voltage according to the third control signal. The seventh switch has a first end, a second end and a control end. The seventh switch is configured to have its control end electrically coupled to the third control signal and its first end electrically coupled to the second end of the second switch. The seventh switch is ON/OFF according to the third control signal. The light emitting unit has a first end and a second end. The light emitting unit is configured to have its first end electrically coupled to the second end of the seventh switch and its second end electrically coupled to a second operation voltage source.

The present disclosure further provides a pixel driving circuit, which includes a first switch, a second switch, a third switch, a fourth switch, a fifth switch, a sixth switch, a seventh switch, a capacitor and a light emitting unit. The first switch has a first end, a second end and a control end. The first switch has a first end, a second end and a control end. The first switch is configured to have its first end electrically coupled to a data voltage. The second switch has a first end, a second end and a control end. The third switch has a first end, a second end and a control end. The third switch is configured to have its first end electrically coupled to the control end of the second switch. The fourth switch has a first end, a second end and a control end. The fourth switch is configured to have its first end electrically coupled to the second end of the third switch and its second end electrically coupled to the first end of the second switch. The fifth switch has a first end, a second end and a control end. The fifth switch is configured to have its control end electrically coupled to a first control signal, its first end electrically coupled between the second end of the third switch and the first end of the fourth switch, and its second end electrically coupled to a first reference voltage. The fifth switch receives the first reference voltage according to the first control signal. The first, third and fourth switches are further configured to have their control ends electrically coupled to a second control signal, respectively, and are ON/OFF according to the second control signal. The capacitor is electrically coupled between the second end of the first switch and the control end of the second switch. The sixth switch has a first end, a second end and a control end. The sixth switch is configured to have its control end electrically coupled to a third control signal, its first end electrically coupled to a second reference voltage, and its second end electrically coupled between the second end of the first switch and the capacitor. The sixth switch receives the second reference voltage according to the third control signal. The seventh switch has a first end, a second end and a control end. The seventh switch is configured to have its control end electrically coupled to the third control signal, its first end electrically coupled to a first operation voltage source, and its second end electrically coupled to the first end of the second switch. The seventh switch is ON/OFF according to the third control signal. The light emitting unit has a first end and a second end. The light emitting unit is configured to have its first end electrically coupled to the second end of the second switch and its second end electrically coupled to a second operation voltage source.

In summary, through employing seven transistors, one capacitor and one light emitting unit with specific configuration, the luminance of the light emitting unit in the pixel driving circuit of the present disclosure is not affected by the threshold voltage of the related transistor; and consequentially, a display apparatus employing the pixel driving circuit of the present disclosure has improved luminance uniformity while displaying images.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
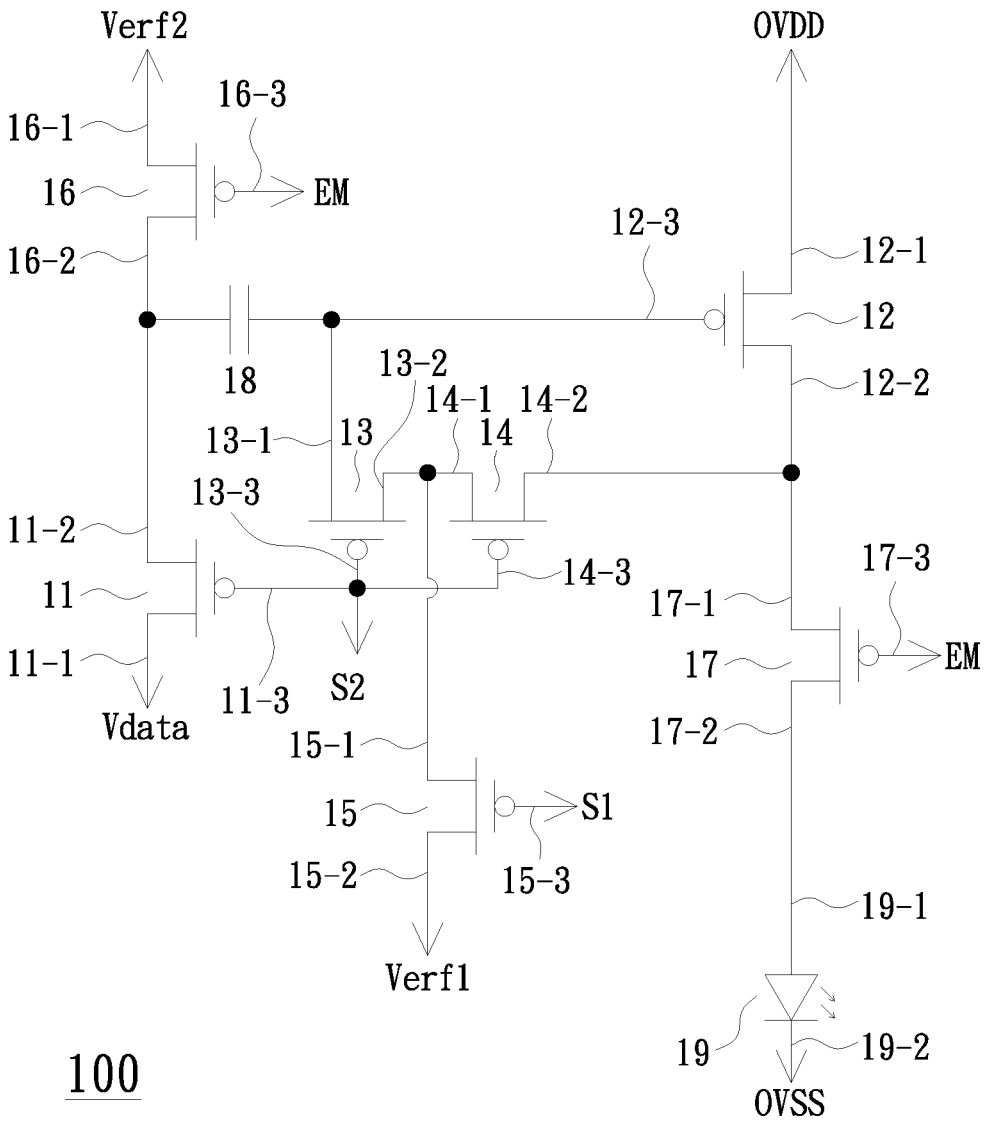
FIG. 1 is a circuit view of a pixel driving circuit in accordance with an embodiment of the present disclosure.

FIG. 1 is a circuit view of a pixel driving circuit in accordance with an embodiment of the present disclosure. As shown in FIG. 1, the pixel driving circuit 100 in the present embodiment includes switches 11, 12, 13, 14, 15, 16 and 17, a capacitor 18 and a light emitting unit 19. The switch 11 has a first end 11-1, a second end 11-2 and a control end 11-3. The switch 11 is configured to have its first end 11-1 electrically coupled to a data voltage Vdata. The switch 12 has a first end 12-1, a second end 12-2 and a control end 12-3. The switch 12 is configured to have its first end 12-1 electrically coupled to an operation voltage source OVDD. The switch 13 has a first end 13-1, a second end 13-2 and a control end 13-3. The switch 13 is configured to have its first end 13-1 electrically coupled to the control end 12-3 of the switch 12. The switch 14 has a first end 14-1, a second end 14-2 and a control end 14-3. The switch 14 is configured to have its first end 14-1 electrically coupled to the second end 13-2 of the switch 13 and its second end 14-2 electrically coupled to the second end 12-2 of the switch 12.

Further, the switch 15 has a first end 15-1, a second end 15-2 and a control end 15-3. The switch 15 is configured to have its control end 15-3 electrically coupled to a control signal S1, its first end 15-1 electrically coupled between the second end 13-2 of the switch 13 and the first end 14-1 of the switch 14, and its second end 15-2 electrically coupled to a reference voltage Vref1. Thus, according to the above circuit configuration, the switch 15 receives the reference voltage Vref1 according to the control signal S1. The switches 11, 13 and 14 are configured to have their control ends 11-3, 13-3 and 14-3 electrically coupled to a control signal S2, respectively. Thus, according to the above circuit configuration, the switches 11, 13 and 14 are ON/OFF according to the control signal S2. The capacitor 18 is electrically coupled between the second end 11-2 of the switch 11 and the control end 12-3 of the switch 12. The switch 16 has a first end 16-1, a second end 16-2 and a control end 16-3. The switch 16 is configured to have its control end 16-3 electrically coupled to a control signal EM, its first end 16-1 electrically coupled to a reference voltage Vref2, and its second end 16-2 electrically coupled between the second end 11-2 of the switch 11 and the capacitor 18. Thus, according to the above circuit configuration, the switch 16 receives the reference voltage Vref2 according to the control signal EM.

Further, the switch 17 has a first end 17-1, a second end 17-2 and a control end 17-3. The switch 17 is configured to have its control end 17-3 electrically coupled to the control signal EM and its first end 17-1 electrically coupled to the second end 12-2 of the switch 12. Thus, according to the above circuit configuration, the switch 17 is ON/OFF according to the control signal EM. The light emitting unit 19 has a first end 19-1 and a second end 19-2. The light emitting unit 19 is configured to have its first end 19-1 electrically coupled to the second end 17-2 of the switch 17 and its second end 19-2 electrically coupled to an operation voltage source OVSS. The light emitting unit 19 is implemented with an organic light emitting diode.

As shown in FIG. 1, it is to be noted that all of the switches 11, 12, 13, 14, 15, 16 and 17 in the pixel driving circuit 100 in the present embodiment are exemplarily implemented with P-type transistors.

Figure 2:
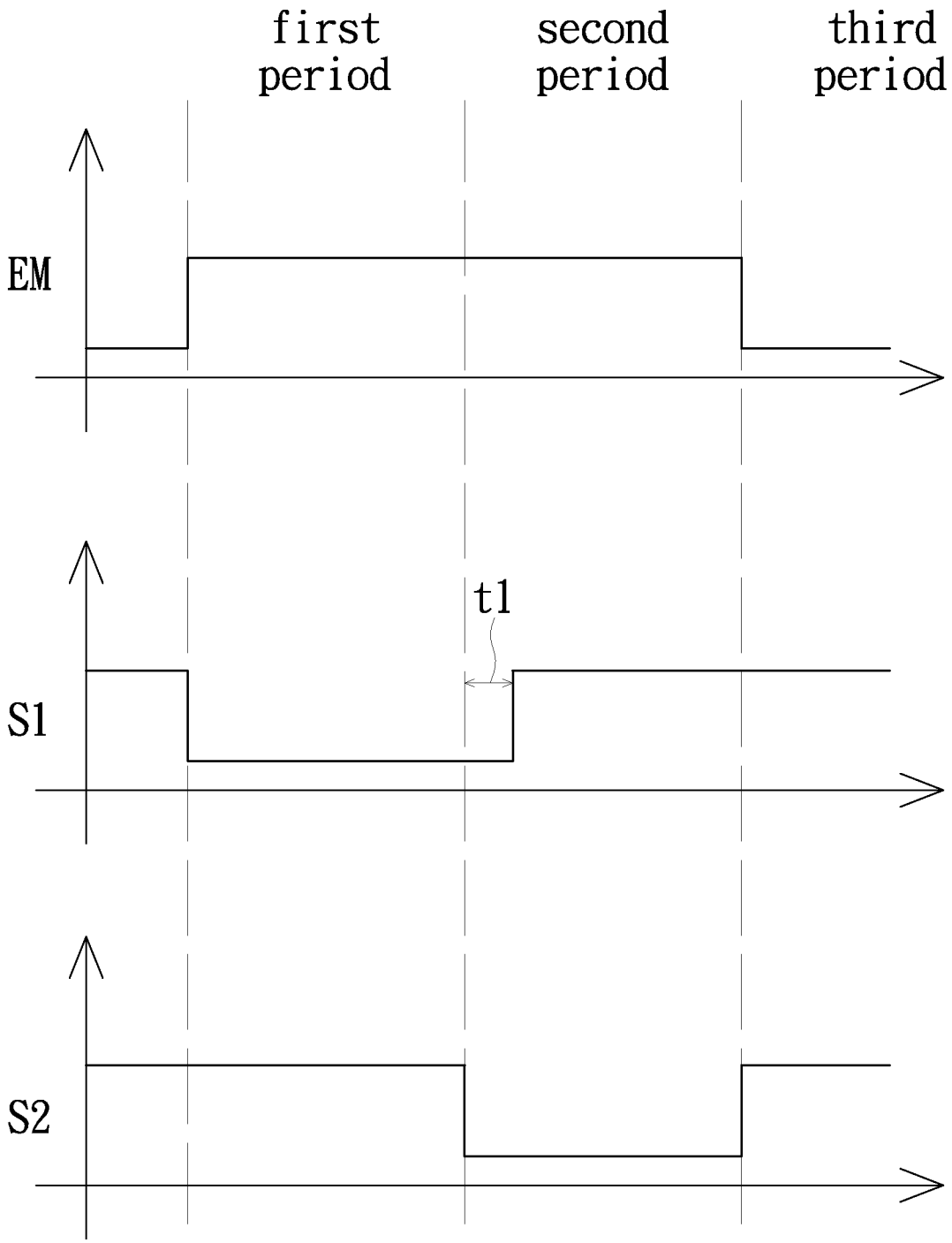
FIG. 2 is a timing chart of the control signals related to the pixel driving circuit of FIG. 1 in accordance with an embodiment of the present disclosure.

FIG. 2 is a timing chart of the control signals related to the pixel driving circuit of FIG. 1 in accordance with an embodiment of the present disclosure. Please refer to FIGS. 1 and 2. The pixel driving circuit 100 is operated in a first period, a second period and a third period sequentially. In the first period, the switch 15 is ON by receiving the control signal S1 and the switches 11, 13, 14, 16 and 17 are OFF. In the second period, the switches 11, 13 and 14 are ON by receiving the control signal S2 and the switch 15 is still ON within a predetermined time t1 in the second period; wherein the length of the predetermined time t1 is shorter than the second period. In the following third period, the switches 16, 17 are ON by receiving the control signal EM and the switches 11, 13, 14 and 15 are OFF.

Specifically, as shown in FIGS. 1 and 2, when the pixel driving circuit 100 is operated in the first period, the switch 15 is ON by receiving the control signal S1 through its control end 15-3. Thus, in the first period, the voltage at the first end 15-1 of the switch 15 is equal to the reference voltage Vref1. When the pixel driving circuit 100 is operated within the predetermined time t1 in the second period, the switches 11, 13 and 14 are ON by receiving the control signal S2 through their control ends 11-3, 13-3 and 14-3, respectively, and the switch 15 is still ON by receiving the control signal S1 through its control end 15-3. Thus, within the predetermined time t1 in the second period, the voltage at the end of the capacitor 18 electrically coupled to the second end 11-2 of the switch 11 is equal to the data voltage Vdata and the end of the capacitor 18 electrically coupled to the control end 12-3 of the switch 12 is equal to the reference voltage Vref1. When the pixel driving circuit 100 is operated in the second period except the predetermined time t1, the switch 15 is OFF and the switches 11, 13 and 14 are still ON. Thus, in the second period except the predetermined time t1, the voltage at the control end 12-3 of the switch 12 is equal to OVDD−Vth, where Vth denotes the threshold voltage of the switch 12.

When the pixel driving circuit 100 is operated in the third period, the switches 11, 13 14 and 15 are OFF and the switches 16, 17 are ON by receiving the control signal EM through their control ends 16-3, 17-3, respectively. Thus, in the third period, the voltage at the end of the capacitor 18 electrically coupled to the second end 16-2 of the switch 16 is changed from Vdata in the second period to Vref2 and has a voltage change Vref2−Vdata. Correspondingly, the voltage at the end of the capacitor 18 electrically coupled to the control end 12-3 of the switch 12 is changed from OVDD−Vth in the second period to OVDD−Vth+Vref2−Vdata. Because the voltage at the control end 12-3 (or, Vg) of the switch 12 is OVDD−Vth+Vref2−Vdata and the voltage at the first end 12-1 (i.e., Vs) of the switch 12 is OVDD, the current flowing through the switch 12 is $Id=K(Vdata-Vref2)^2$, which is obtained based on the transistor current equation $Id=K(Vsg-|Vth|)^2=K(Vs-Vg-|Vth|)^2$, where K denotes a dielectric constant. In addition, because the light emitting unit 19 is driven by the current flowing thorough the turned-on switch 12, it is to be noted that the luminance of the light emitting unit 19 is no longer affected by the threshold voltage Vth of the switch 12 in the present embodiment; as a result, the object of the present disclosure is achieved.

Figure 3:
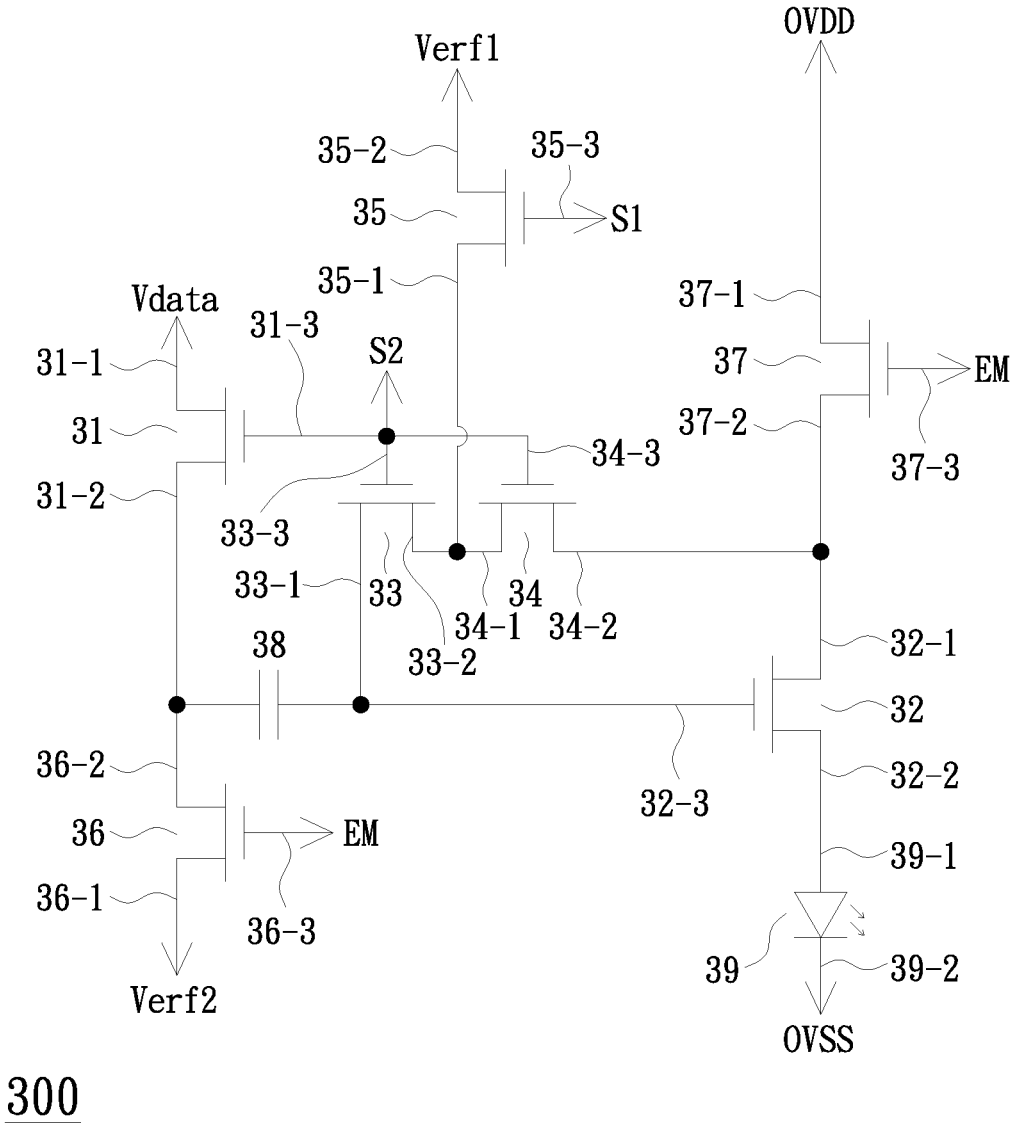
FIG. 3 is a circuit view of a pixel driving circuit in accordance with another embodiment of the present disclosure.

FIG. 3 is a circuit view of a pixel driving circuit in accordance with another embodiment of the present disclosure. The component/signal having the same label number in FIGS. 1, 3 represents the same component/signal. As shown in FIG. 3, the pixel driving circuit 300 in the present embodiment includes switches 31, 32, 33, 34, 35, 36 and 37, a capacitor 38 and a light emitting unit 39. The switch 31 has a first end 31-1, a second end 31-2 and a control end 31-3. The switch 31 is configured to have its first end 31-1 electrically coupled to a data voltage Vdata. The switch 32 has a first end 32-1, a second end 32-2 and a control end 32-3. The switch 33 has a first end 33-1, a second end 33-2 and a control end 33-3. The switch 33 is configured to have its first end 33-1 electrically coupled to the control end 32-3 of the switch 32. The switch 34 has a first end 34-1, a second end 34-2 and a control end 34-3. The switch 34 is configured to have its first end 34-1 electrically coupled to the second end 33-2 of the switch 33 and its second end 34-2 electrically coupled to the first end 32-1 of the switch 32.

Further, the switch 35 has a first end 35-1, a second end 35-2 and a control end 35-3. The switch 35 is configured to have its control end 35-3 electrically coupled to a control signal S1, its first end 35-1 electrically coupled between the second end 33-2 of the switch 33 and the first end 34-1 of the switch 34, and its second end 35-2 electrically coupled to a reference voltage Vref1. Thus, according to the above circuit configuration, the switch 15 receives the reference voltage Vref1 according to the control signal S1. The switches 31, 33 and 34 are configured to have their control ends 31-3, 33-3 and 34-3 electrically coupled to a control signal S2, respectively. Thus, according to the above circuit configuration, the switches 31, 33 and 34 are ON/OFF according to the control signal S2. The capacitor 38 is electrically coupled between the second end 31-2 of the switch 31 and the control end 32-3 of the switch 32. The switch 36 has a first end 36-1, a second end 36-2 and a control end 36-3. The switch 36 is configured to have its control end 36-3 electrically coupled to a control signal EM, its first end 36-1 electrically coupled to a reference voltage Vref2, and its second end 36-2 electrically coupled between the second end 31-2 of the switch 31 and the capacitor 38. Thus, according to the above circuit configuration, the switch 36 receives the reference voltage Vref2 according to the control signal EM.

Further, the switch 37 has a first end 37-1, a second end 37-2 and a control end 37-3. The switch 37 is configured to have its control end 37-3 electrically coupled to the control signal EM, its first end 37-1 electrically coupled to an operation voltage source OVSS, and its second end 37-2 electrically coupled to the first end 32-1 of the switch 32. Thus, according to the above circuit configuration, the switch 37 is ON/OFF according to the control signal EM. The light emitting unit 39 has a first end 39-1 and a second end 39-2. The light emitting unit 39 is configured to have its first end 39-1 electrically coupled to the second end 32-2 of the switch 32 and its second end 39-2 electrically coupled to the operation voltage source OVSS.

As shown in FIG. 3, it is to be noted that all of the switches 31, 32, 33, 34, 35, 36 and 37 in the pixel driving circuit 300 in the present embodiment are exemplarily implemented with N-type transistors.

Figure 4:
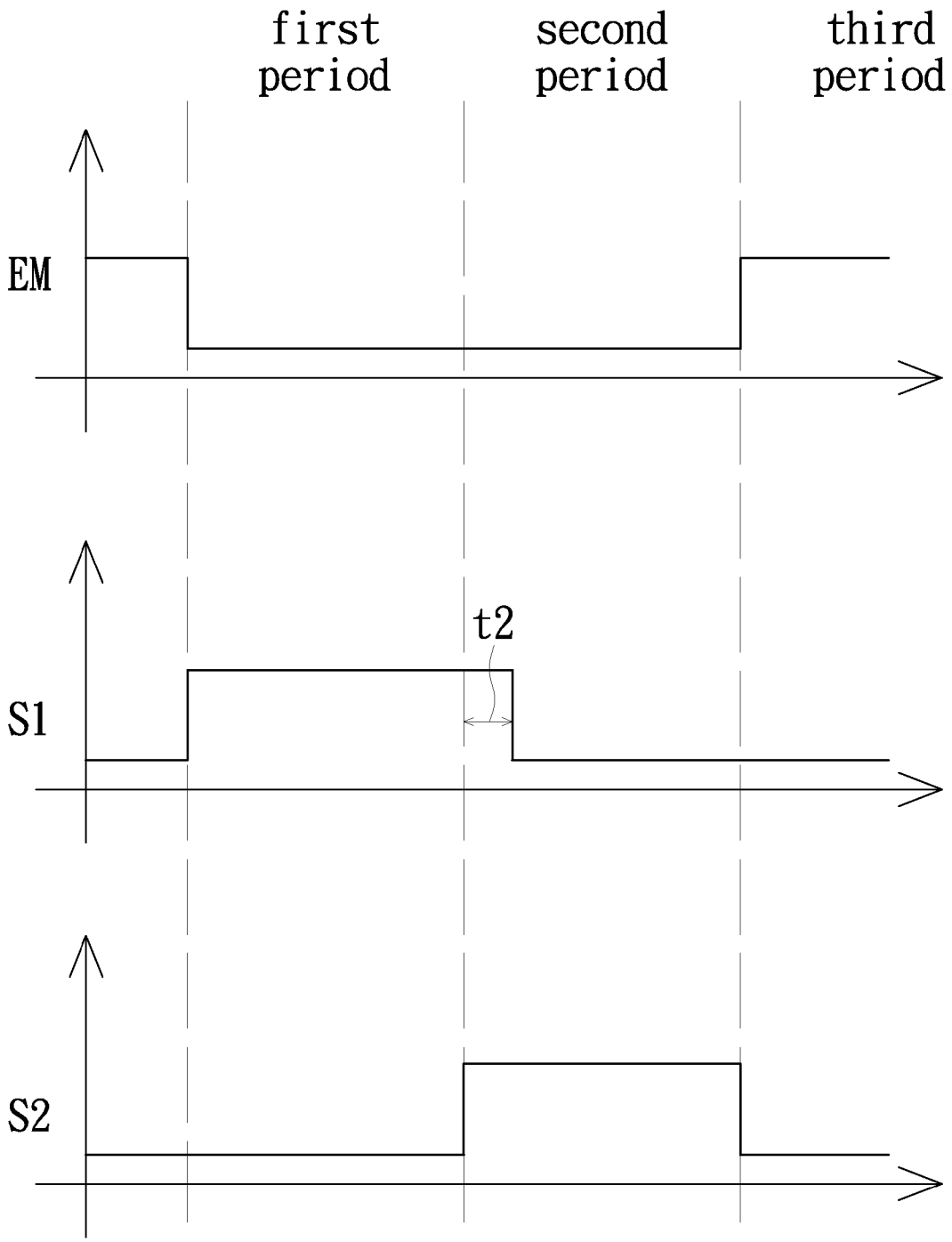
FIG. 4 is a timing chart of the control signals related to the pixel driving circuit of FIG. 3 in accordance with another embodiment of the present disclosure.

FIG. 4 is a timing chart of the control signals related to the pixel driving circuit of FIG. 3 in accordance with another embodiment of the present disclosure. Please refer to FIGS. 3 and 4. The pixel driving circuit 300 is operated in a first period, a second period and a third period sequentially. In the first period, the switch 35 is ON and the switches 31, 33, 34, 36 and 37 are OFF. In the second period, the switches 31, 33 and 34 are ON and the switch 35 is still ON within a predetermined time t2 in the second period; wherein the length of the predetermined time t2 is shorter than the second period. In the third period, the switches 36, 37 are ON and the switches 31, 33, 34 and 35 are OFF. In one embodiment, the predetermined time t2 in FIG. 4 is equal to the predetermined time t1 in FIG. 2.

Same as the pixel driving circuit 100 of FIG. 1 in the previous embodiment, the luminance of the light emitting unit 39 in the pixel driving circuit 300 of FIG. 3 in the present embodiment is no longer affected by the threshold voltage Vth of the switch 32; as a result, the object of the present disclosure is achieved. Because the pixel driving circuit 300 of FIG. 3 and the pixel driving circuit 100 of FIG. 1 have a similar circuit configuration, no redundant detail is to be given herein.

In summary, through employing seven transistors, one capacitor and one light emitting unit with specific configuration, the luminance of the light emitting unit in the pixel driving circuit of the present disclosure is not affected by the threshold voltage of the related transistor; and consequentially, a display apparatus employing the pixel driving circuit of the present disclosure has improved luminance uniformity while displaying images.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel driving circuit, comprising:

a first switch, having a first end, a second end and a control end, the first switch being configured to have its first end electrically coupled to a data voltage;

a second switch, having a first end, a second end and a control end, the second switch being configured to have its first end electrically coupled to a first operation voltage source;

a third switch, having a first end, a second end and a control end, the third switch being configured to have its first end electrically coupled to the control end of the second switch;

a fourth switch, having a first end, a second end and a control end, the fourth switch being configured to have its first end electrically coupled to the second end of the third switch and its second end electrically coupled to the second end of the second switch;

a fifth switch, having a first end, a second end and a control end, the fifth switch being configured to have its control end electrically coupled to a first control signal, its first end electrically coupled between the second end of the third switch and the first end of the fourth switch, and its second end electrically coupled to a first reference voltage, wherein the fifth switch receives the first reference voltage according to the first control signal, the first, third and fourth switches are further configured to have their control ends electrically coupled to a second control signal, respectively, and are ON/OFF according to the second control signal;

a capacitor, electrically coupled between the second end of the first switch and the control end of the second switch;

a sixth switch, having a first end, a second end and a control end, the sixth switch being configured to have its control end electrically coupled to a third control signal, its first end electrically coupled to a second reference voltage, and its second end electrically coupled between the second end of the first switch and the capacitor, wherein the sixth switch receives the second reference voltage according to the third control signal;

a seventh switch, having a first end, a second end and a control end, the seventh switch being configured to have its control end electrically coupled to the third control signal and its first end electrically coupled to the second end of the second switch, wherein the seventh switch is ON/OFF according to the third control signal; and a light emitting unit, having a first end and a second end, the light emitting unit being configured to have its first end electrically coupled to the second end of the seventh switch and its second end electrically coupled to a second operation voltage source;

wherein the pixel driving circuit is operated in a first period, a second period and a third period sequentially, wherein in the first period, the fifth switch is ON and the first, third, fourth, sixth and seventh switches are OFF; wherein in the second period, the first, third and fourth switches are ON and the fifth switch is still ON within a predetermined time in the second period, the length of the predetermined time is shorter than the second period, wherein in the third period, the sixth and seventh switches are ON and the first, third, fourth and fifth switches are OFF.

2. The pixel driving circuit according to claim 1, wherein the first, second, third, fourth, fifth, sixth and seventh switches are implemented with P-type transistors.

3. A pixel driving circuit, comprising:

a first switch, having a first end, a second end and a control end, the first switch being configured to have its first end electrically coupled to a data voltage;

a second switch, having a first end, a second end and a control end;

a third switch, having a first end, a second end and a control end, the third switch being configured to have its first end electrically coupled to the control end of the second switch;

a fourth switch, having a first end, a second end and a control end, the fourth switch being configured to have its first end electrically coupled to the second end of the third switch and its second end electrically coupled to the first end of the second switch;

a fifth switch, having a first end, a second end and a control end, the fifth switch being configured to have its control end electrically coupled to a first control signal, its first end electrically coupled between the second end of the third switch and the first end of the fourth switch, and its second end electrically coupled to a first reference voltage, wherein the fifth switch receives the first reference voltage according to the first control signal, the first, third and fourth switches are further configured to have their control ends electrically coupled to a second control signal, respectively, and are ON/OFF according to the second control signal;

a capacitor, electrically coupled between the second end of the first switch and the control end of the second switch;

a sixth switch, having a first end, a second end and a control end, the sixth switch being configured to have its control end electrically coupled to a third control signal, its first end electrically coupled to a second reference voltage, and its second end electrically coupled between the second end of the first switch and the capacitor, wherein the sixth switch receives the second reference voltage according to the third control signal;

a seventh switch, having a first end, a second end and a control end, the seventh switch being configured to have its control end electrically coupled to the third control signal, its first end electrically coupled to a first operation voltage source, and its second end electrically coupled to the first end of the second switch, wherein the seventh switch is ON/OFF according to the third control signal; and a light emitting unit, having a first end and a second end, the light emitting unit being configured to have its first end electrically coupled to the second end of the second switch and its second end electrically coupled to a second operation voltage source;

wherein the pixel driving circuit is operated in a first period, a second period and a third period sequentially, wherein in the first period, the fifth switch is ON and the first, third, fourth, sixth and seventh switches are OFF; wherein in the second period, the first, third and fourth switches are ON and the fifth switch is still ON within a predetermined time in the second period, the length of the predetermined time is shorter than the second period, wherein in the third period, the sixth and seventh switches are ON and the first, third, fourth and fifth switches are OFF.

4. The pixel driving circuit according to claim 3, wherein the first, second, third, fourth, fifth, sixth and seventh switches are implemented with N-type transistors.

* * * * *